US010662711B2

(12) United States Patent
Reese et al.

(10) Patent No.: US 10,662,711 B2
(45) Date of Patent: May 26, 2020

(54) LATERALLY ORIENTED CUTTING STRUCTURES

(71) Applicant: XR LATERAL LLC, Houston, TX (US)

(72) Inventors: Michael Reese, Houston, TX (US); Gregory C. Prevost, Spring, TX (US)

(73) Assignee: XR Lateral LLC, Houston, TX (US)

( * ) Notice: Subject to any disclaimer, the term of this patent is extended or adjusted under 35 U.S.C. 154(b) by 0 days.

(21) Appl. No.: 16/030,965

(22) Filed: Jul. 10, 2018

(65) Prior Publication Data

US 2019/0017328 A1 Jan. 17, 2019

Related U.S. Application Data

(60) Provisional application No. 62/531,738, filed on Jul. 12, 2017.

(51) Int. Cl.

| | |
|---|---|
| ***E21B 7/06*** | (2006.01) |
| ***E21B 10/43*** | (2006.01) |
| ***E21B 10/16*** | (2006.01) |
| *E21B 10/567* | (2006.01) |
| *E21B 10/14* | (2006.01) |

(52) U.S. Cl.

CPC ..... *E21B 7/064* (2013.01); *E21B 10/16* (2013.01); *E21B 10/43* (2013.01); *E21B 10/14* (2013.01); *E21B 10/567* (2013.01)

(58) Field of Classification Search

CPC ..... E21B 7/064; E21B 10/16; E21B 10/43

See application file for complete search history.

(56) References Cited

U.S. PATENT DOCUMENTS

| | | | |
|---|---|---|---|
| 356,154 | A | 1/1887 | William et al. |
| 1,638,337 | A | 8/1927 | Hutton et al. |
| 1,667,155 | A | 4/1928 | Higdon et al. |
| 2,919,897 | A | 1/1960 | Sims et al. |
| 3,061,025 | A | 10/1962 | Stockard et al. |
| 3,159,224 | A | 12/1964 | Cleary et al. |
| 3,224,513 | A | 12/1965 | Weeden, Jr. et al. |
| 3,561,549 | A | 2/1971 | Garrison et al. |

(Continued)

FOREIGN PATENT DOCUMENTS

| | | |
|---|---|---|
| CA | 2291922 A1 | 6/2000 |
| EP | 530045 B1 | 4/1997 |

OTHER PUBLICATIONS

Felczak , et al., "The Best of Both Worlds—A Hybrid Rotary Steerable System", Oilfield Review; vol. 23, No. 4, Winter 2011, pp. 36-44.

(Continued)

*Primary Examiner* — Kristyn A Hall

(74) *Attorney, Agent, or Firm* — Michael S. McCoy; Amatong McCoy LLC

(57) ABSTRACT

A drill bit mounted on or integral to a mandrel on the distal end of a downhole motor directional assembly is provided. The drill bit is in a fixed circumferential relationship with the activating mechanism of one or more dynamic lateral pads (DLP). The technologies of the present application assist in and optionally control the extent of lateral movement of the drill bit. The technologies include, among other things, the placement and angulation of the cutting structures in the cone areas of the blades on the drill bit.

17 Claims, 14 Drawing Sheets

(56) References Cited

U.S. PATENT DOCUMENTS

| | | | |
|---|---|---|---|
| 3,880,246 | A | 4/1975 | Farris |
| 3,882,946 | A | 5/1975 | Ioannesian |
| 4,270,619 | A | 6/1981 | Base et al. |
| 4,373,592 | A | 2/1983 | Dellinger et al. |
| 4,385,669 | A | 5/1983 | Knutsen et al. |
| 4,407,377 | A | 10/1983 | Russell |
| 4,456,080 | A | 6/1984 | Holbert et al. |
| 4,465,147 | A | 8/1984 | Feenstra et al. |
| 4,485,879 | A | 12/1984 | Kamp et al. |
| 4,491,187 | A | 1/1985 | Russell |
| 4,492,276 | A | 1/1985 | Kamp et al. |
| 4,523,652 | A | 6/1985 | Schuh et al. |
| 4,577,701 | A | 3/1986 | Dellinger et al. |
| 4,618,010 | A | 10/1986 | Falgout et al. |
| 4,667,751 | A | 5/1987 | Geczy et al. |
| 4,690,229 | A | 9/1987 | Raney et al. |
| 4,697,651 | A | 10/1987 | Dellinger |
| 4,715,453 | A | 12/1987 | Falgout et al. |
| 4,729,438 | A | 3/1988 | Walker et al. |
| 4,775,017 | A | 10/1988 | Forrest et al. |
| 4,842,083 | A | 6/1989 | Raney et al. |
| 4,848,490 | A | 7/1989 | Anderson et al. |
| 4,862,974 | A | 9/1989 | Warren et al. |
| 4,877,092 | A | 10/1989 | Helm et al. |
| 5,010,789 | A | 4/1991 | Brett et al. |
| 5,042,596 | A | 8/1991 | Brett et al. |
| 5,099,929 | A | 3/1992 | Keith et al. |
| 5,115,872 | A | 5/1992 | Brunet et al. |
| 5,139,094 | A | 8/1992 | Prevedel et al. |
| 5,159,577 | A | 10/1992 | Twist et al. |
| 5,181,576 | A | 1/1993 | Askew et al. |
| 5,320,179 | A | 6/1994 | Roos et al. |
| 5,333,699 | A | 8/1994 | Thigpen et al. |
| 5,361,859 | A | 11/1994 | Tibbitts et al. |
| 5,458,208 | A | 10/1995 | Clarke |
| 5,673,763 | A | 10/1997 | Thorp |
| 5,812,068 | A | 9/1998 | Hubner et al. |
| 5,857,531 | A | 1/1999 | Estep et al. |
| 5,904,213 | A | 5/1999 | Caraway et al. |
| 5,931,239 | A | 8/1999 | Schuh |
| 5,937,958 | A | 8/1999 | Mensa-Wilmot et al. |
| 5,957,223 | A | 9/1999 | Doster et al. |
| 5,967,246 | A | 10/1999 | Caraway et al. |
| 5,971,085 | A | 10/1999 | Colebrook et al. |
| 5,979,570 | A | 11/1999 | McLoughlin et al. |
| 5,992,547 | A | 11/1999 | Caraway et al. |
| 6,073,707 | A | 6/2000 | Noe et al. |
| 6,092,613 | A | 7/2000 | Caraway et al. |
| 6,109,372 | A | 8/2000 | Dorel et al. |
| 6,116,356 | A | 9/2000 | Doster et al. |
| 6,158,533 | A | 12/2000 | Gillis et al. |
| 6,186,251 | B1 | 2/2001 | Butcher et al. |
| 6,213,226 | B1 | 4/2001 | Eppink et al. |
| 6,257,356 | B1 | 7/2001 | Wassell et al. |
| 6,349,780 | B1 | 2/2002 | Beuershausen et al. |
| 6,427,792 | B1 | 8/2002 | Roberts et al. |
| 6,523,623 | B1 | 2/2003 | Schuh et al. |
| 6,722,453 | B1 | 4/2004 | Crooks et al. |
| 6,742,605 | B2 | 6/2004 | Martini et al. |
| 6,991,046 | B2 | 1/2006 | Fielder et al. |
| 7,207,398 | B2 | 4/2007 | Runia et al. |
| 7,562,725 | B1 | 7/2009 | Broussard et al. |
| 7,831,419 | B2 | 11/2010 | Cariveau et al. |
| 8,061,453 | B2 | 11/2011 | Cariveau et al. |
| 8,162,081 | B2 | 4/2012 | Ballard et al. |
| 8,201,642 | B2 | 6/2012 | Radford et al. |
| 8,210,283 | B1 | 7/2012 | Benson et al. |
| 8,240,399 | B2 | 8/2012 | Kulkarni et al. |
| 8,316,968 | B2 | 11/2012 | Ferrari et al. |
| 8,448,721 | B2 | 5/2013 | Johnson et al. |
| 8,448,722 | B2 | 5/2013 | Konschuh et al. |
| 8,550,190 | B2 | 10/2013 | Hall et al. |
| 8,757,298 | B2 | 6/2014 | Broussard et al. |
| 8,763,726 | B2 | 7/2014 | Johnson et al. |
| D710,174 | S | 8/2014 | Moss |
| D710,175 | S | 8/2014 | Moss et al. |
| D710,176 | S | 8/2014 | Santamarina |
| D713,706 | S | 9/2014 | Jing et al. |
| D717,626 | S | 11/2014 | Dickrede |
| 8,905,159 | B2 | 12/2014 | Downton |
| 9,016,400 | B2 | 4/2015 | Clausen et al. |
| D731,277 | S | 6/2015 | Manwaring et al. |
| D732,364 | S | 6/2015 | Rinaldis et al. |
| 9,163,460 | B2 | 10/2015 | Meier et al. |
| 9,556,683 | B2 | 1/2017 | Simmons et al. |
| 9,605,482 | B2 | 3/2017 | Lange et al. |
| D786,645 | S | 5/2017 | Svendsen et al. |
| D793,831 | S | 8/2017 | Russell et al. |
| D793,832 | S | 8/2017 | Russell et al. |
| D793,833 | S | 8/2017 | Russell et al. |
| D813,003 | S | 3/2018 | Chang |
| 9,963,938 | B2 | 5/2018 | Foote et al. |
| 2002/0070021 | A1 | 6/2002 | Van et al. |
| 2002/0175006 | A1 | 11/2002 | Findley et al. |
| 2003/0010534 | A1 | 1/2003 | Chen et al. |
| 2003/0024742 | A1 | 2/2003 | Swietlik et al. |
| 2004/0216921 | A1 | 11/2004 | Krueger et al. |
| 2005/0096847 | A1 | 5/2005 | Huang |
| 2005/0150692 | A1 | 7/2005 | Ballantyne et al. |
| 2005/0236187 | A1 | 10/2005 | Chen et al. |
| 2006/0196697 | A1 | 9/2006 | Raney et al. |
| 2007/0007000 | A1 | 1/2007 | Dewey et al. |
| 2007/0163810 | A1 | 7/2007 | Underwood et al. |
| 2007/0205024 | A1 | 9/2007 | Mensa-Wilmot et al. |
| 2007/0235227 | A1 | 10/2007 | Kirkhope et al. |
| 2007/0272445 | A1 | 11/2007 | Cariveau et al. |
| 2008/0000693 | A1 | 1/2008 | Hutton et al. |
| 2008/0047754 | A1 | 2/2008 | Evans et al. |
| 2008/0075618 | A1 | 3/2008 | Martin et al. |
| 2008/0115974 | A1 | 5/2008 | Johnson et al. |
| 2008/0190665 | A1 | 8/2008 | Earles et al. |
| 2008/0271923 | A1 | 11/2008 | Kusko et al. |
| 2009/0000823 | A1 | 1/2009 | Pirovolou |
| 2009/0044980 | A1 | 2/2009 | Sheppard et al. |
| 2009/0044981 | A1 | 2/2009 | Sheppard et al. |
| 2009/0065262 | A1 | 3/2009 | Downton et al. |
| 2009/0107722 | A1 | 4/2009 | Chen et al. |
| 2009/0188720 | A1 | 7/2009 | Johnson et al. |
| 2010/0006341 | A1 | 1/2010 | Downton |
| 2010/0307837 | A1 | 12/2010 | King et al. |
| 2011/0031025 | A1 | 2/2011 | Kulkarni et al. |
| 2011/0247816 | A1 | 10/2011 | Carter |
| 2012/0055713 | A1 | 3/2012 | Herberg et al. |
| 2012/0234610 | A1* | 9/2012 | Azar ..... E21B 10/26 175/431 |
| 2013/0180782 | A1 | 7/2013 | Ersan et al. |
| 2014/0097026 | A1 | 4/2014 | Clark et al. |
| 2014/0110178 | A1 | 4/2014 | Savage et al. |
| 2014/0246209 | A1 | 9/2014 | Themig et al. |
| 2014/0246234 | A1 | 9/2014 | Gillis et al. |
| 2014/0311801 | A1 | 10/2014 | Jain et al. |
| 2014/0379133 | A1 | 12/2014 | Toma |
| 2015/0122551 | A1 | 5/2015 | Chen |
| 2015/0152723 | A1 | 6/2015 | Hay |
| 2016/0024846 | A1 | 1/2016 | Parkin |
| 2016/0024848 | A1 | 1/2016 | Desmette et al. |
| 2016/0115779 | A1 | 4/2016 | Moss et al. |
| 2016/0265287 | A1 | 9/2016 | Newman et al. |
| 2016/0326863 | A1 | 11/2016 | Lange et al. |
| 2017/0130533 | A1 | 5/2017 | Ling |
| 2017/0234071 | A1 | 8/2017 | Spatz et al. |
| 2018/0073301 | A1 | 3/2018 | Russell et al. |
| 2019/0055810 | A1 | 2/2019 | Fripp et al. |

OTHER PUBLICATIONS

Warren , et al., "Casing Directional Drilling", AADE-05-NTCE-48; American Association of Drilling Engineers (AADE) 2005 National Technical Conference and Exhibition, Houston, Texas, Apr. 5-7, 2005, pp. 1-10.

International Search Report and Written Opinion in PCT Application No. PCT/US2017/066707, dated Apr. 8, 2018, 13 pages.

(56) References Cited

OTHER PUBLICATIONS

International Search Report and Written Opinion in PCT Application No. PCT/US18/41316, dated Sep. 25, 2018, 14 pages.
International Search Report and the Written Opinion in PCT Patent Application No. PCT/US2017/017515, dated Apr. 28, 2017, 8 pages.
International Search Report and Written Opinion in PCT Patent Application No. PCT/US2017/066745, dated Feb. 15, 2018, 9 pages.
"Direction deviation tools", PetroWiki, downloaded Nov. 13, 2017 from http://petrowiki.org/Directional_deviation_tools, 5 pages.
"Rotary Steerable Motor for Directional Drilling", APS Technology, downloaded Nov. 13, 2017 from http://www.aps-tech.com/products/drilling-systems/rotary-steerable-motor, 4 pages.

* cited by examiner

LATERALLY ORIENTED CUTTING STRUCTURES

CROSS-REFERENCE TO RELATED APPLICATION(S)

The present application claims the benefit of and priority to U.S. Provisional Patent Application Ser. No. 62/531,738, filed Jul. 12, 2017, the disclosure of which is incorporated herein as if set out in full.

FIELD OF INVENTION

The technology of the present application discloses drill bit cutting structures, and drill bits for terrestrial drilling which take advantage of the technologies of "Drilling Machine" which is U.S. patent application Ser. No. 15/430,254 filed Feb. 10, 2017 which is assigned to the same assignee as the present application and which is incorporated in its entirety herein as if set out in full.

DESCRIPTION OF THE PRIOR ART

Prior art drill bit designs have been optimized for "on center" running. With the recognition of bit whirl in the 1980's as a high frequency destructive "off center" rotation mode designers and manufacturers of drill bits redoubled efforts to insure "on center" running employing methods including force balancing of cutting structure forces, blade asymmetry, tracking cutters, and axial or circumferential over engagement limiters among others. The purpose of these developments was to keep the bit running "on center" or to restore it to "on center" running should it begin shifting to "off center" running.

SUMMARY

The technology of the present application presents drill bit cutting structures that take advantage of the oriented cyclical lateral motion imparted by the technologies described in the aforementioned application for "Drilling Machine". The technologies of this application may be applied to PDC, roller cone, impregnated diamond, hybrid PDC/impregnated diamond, or hybrid PDC/roller cone drill bits.

In the technology of "Drilling Machine" a drill bit is mounted on or integral to a mandrel on the distal end of a downhole motor directional assembly. The drill bit is in a fixed circumferential relationship with the activating mechanism of one or more dynamic lateral pads (DLP). In part the purpose of the "Drilling Machine" technologies is to directionally deviate the trajectory of the wellbore in a desired direction when the drill string is not being rotated, in what is termed "slide mode". The technologies of the present application assist in and optionally control the extent of lateral movement of the drill bit when it is subjected to the oriented cyclical lateral forces imparted by the "Drilling Machine" technologies.

Typical drill bits can be used to good effect with the technology of "Drilling Machine", however the technologies of the present application are intended to improve the drill bit performance and directional response of the "Drilling Machine" technologies.

The drill bits and cutting structures of the present application allow for increased lateral movement in response to cyclical oriented lateral force inputs. This capability increases the potential build angle or dogleg severity of the bottomhole assembly (BHA) that incorporates the "Drilling Machine" technologies. The technologies of the present application can be used in conjunction with BHAs that additionally include bent motor housing technology, bent sub directional technology, or downhole motor assisted rotary steerable system technology.

The technology of the present application enables a desired increased oriented lateral movement of the drill bit in response to the cyclical input force of the DLP(s) by enhancing lateral cutting in the desired direction, or by reducing resistance to lateral movement in the desired direction, or by a combination of these two approaches. The goal of enhancing lateral movement can be accomplished by new configurations of cutting structures or by new configurations of gauge pads, impact protectors, or by combinations of configurations of thereof.

The technology of this application enables a rapid oriented lateral response to the force input from the DLP. In some instances the bit designer may determine to limit the maximum extent of the lateral translation. The technology of the present application may employ several methods to accomplish lateral translation limitation. A smooth, extended gauge section generally opposite the DLP may be employed such as in U.S. Pat. Nos. 6,092,613, 5,967,246, 5,904,213, or 5,992,547 all of which are incorporated by reference herein in their entirety. Or one or more spherical ended tungsten carbide inserts may be used on the gauge section(s) generally opposite the DLP to limit the extent of engagement of gauge PDC cutters deployed on the gauge pads such as in U.S. Pat. No. 5,333,699 which is incorporated herein in its entirety.

An alternative method is to apply a lower tungsten carbide content hardfacing to the gauge pad(s) generally opposite the DLP when it is activated. This allows this pad or pads to wear somewhat faster than the remaining gauge pads on the bit. This wear allows for an increasing lateral translation of the drill bit while limiting its ultimate extent.

The technologies of the present application can be used in conjunction with the dynamic lateral cutter (DLC) technology described in the "Drilling Machine" application. In this instance the oriented lateral cutting structure of the bit works in conjunction with the Scribe Side DLC in addition to the DLP to increase the lateral movement of the bit and drilling assembly towards the desired directional path.

Drill bits of the present application may be force balanced for "on center" running using force balancing methods as known in the art. They may additionally be force balanced for the translated "center" created by the activation of the DLP and the lateral translation of the bit. The two force balancing adjustments may be made iteratively first one then the other until acceptable force balance values are produced for both the "on center" condition and the laterally translated "off center" condition of the drill bit.

It is an object of the technologies of the present application to provide a drill bit which can be more readily and controllably translated laterally when subjected to a cyclical lateral load, either by better cutting in the indexed lateral direction, or by failing to resist lateral translation in the oriented lateral direction.

It is an object of the technologies of the present application to provide drill bit technology which can accelerate the build rate or turn rate potential of a directional drilling system employing the technologies disclosed in the "Drilling Machine" application.

It is an object of the technology of the present application to provide drill bit technology which can be employed in conjunction with dynamic lateral cutter (DLC) technology to accelerate build and turn rates of bottom hole assemblies.

It is an object of the technologies of the present application to provide drill bit technology that is efficient in both "on center" running and in running that includes oriented cyclical lateral force.

It is an object of an embodiment of the technologies of the present application to provide a drill bit gauge section or sections generally opposite a DLP which are under full hole gauge diameter and do not resist lateral translation in the oriented Scribe Side direction.

It is an object of an embodiment of the technologies of the present application to provide an undersized drill bit gauge section or sections set with aggressive cutting gauge elements generally opposite an activated DLP to better attack the borehole wall on the Scribe Side when subjected to oriented lateral force imparted by the DLP.

It is an object of an embodiment of the technologies of the present application to provide a smooth, circumferentially extended gauge section opposite the DLP to limit the potential for excessive lateral translation of the drill bit in response to the lateral force imparted by the DLP.

It is an object of an embodiment of the technologies of the present application to provide lateral penetration limiters in conjunction with gauge cutters to define the maximum unimpeded lateral translation of the drill bit in response to the oriented lateral force imparted by the DLP. Although dome shaped penetration limiters are disclosed in the application, any penetration limiter, whether fixed, or active, as known in the art, may be used. These can include but are not limited to rollers, hydraulic, spring activated, or elastomeric shock or movement limiters.

It is an object of an embodiment of the technologies of the present application to provide reduced tungsten carbide content hardfacing to facilitate more rapid wear on the gauge pad or pads generally opposite the DLP side of the bit.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Figure 1:
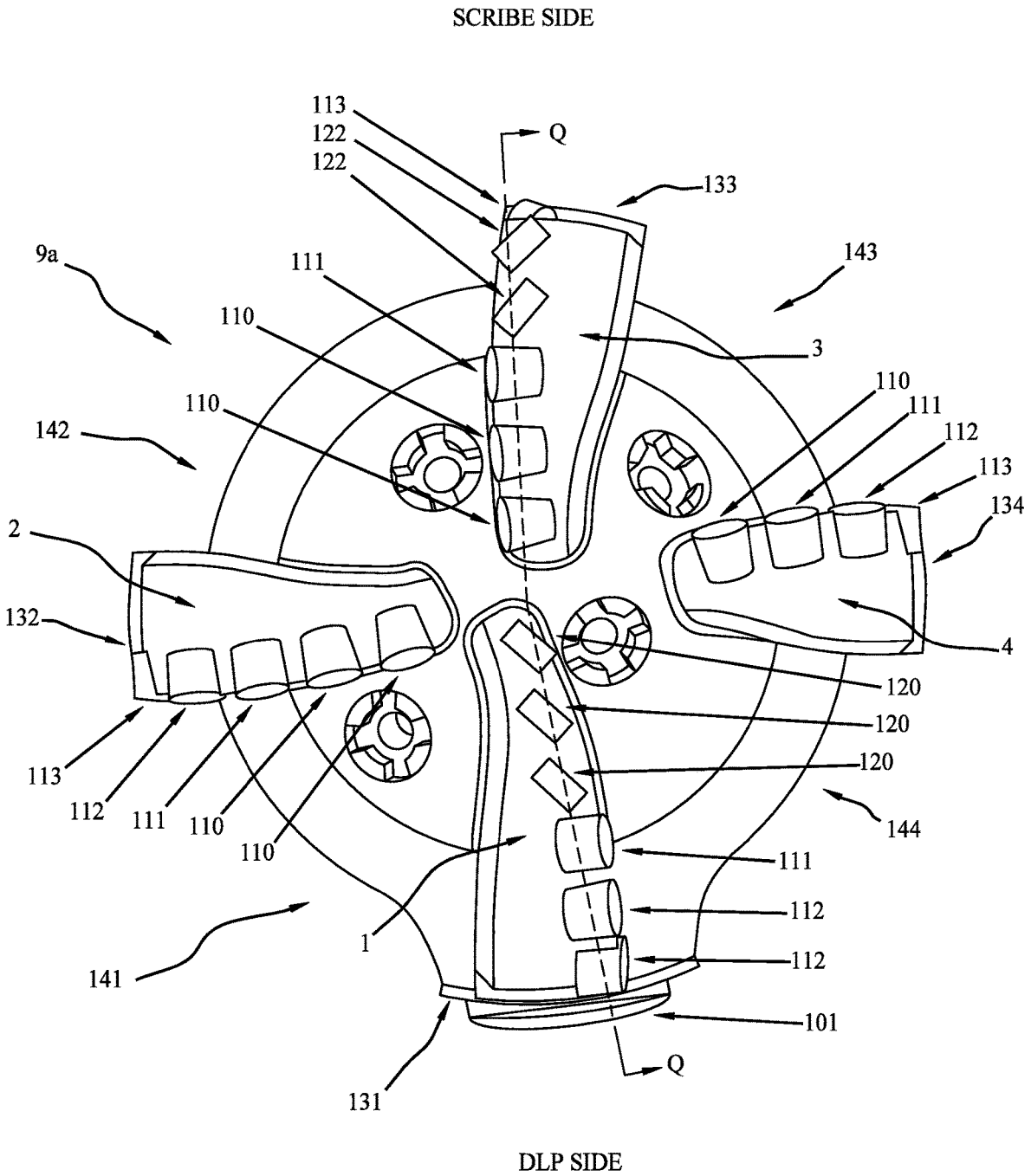
FIG. 1 provides a face plan view of a four blade drill bit incorporating lateral cutters on the cone area of the bit on the blade that is generally on the DLP side of the bit and lateral cutters on the shoulder area of the bit on the blade that is generally opposite the DLP side of the bit.

FIG. 1 is a face view of one embodiment of the technology of the application. FIG. 1 shows an activated Dynamic Lateral Pad (DLP) in alignment with gauge pad 131 of four blade drill bit 9*a*. DLP 101 is shown with exaggerated extension for clarity. Cone lateral cutters 120 are mounted in the cone area of blade 1 generally on the same side of the bit as the DLP 101. The cone lateral cutters 120 have what is termed in the art as a "negative side rake" in that they are skewed inward towards the center of the bit typically three degrees to fifty degrees. Shoulder lateral cutters 122 are mounted in the shoulder area of the bit on blade 3 generally opposite the side of the bit as the DLP 101. In the technology of this application this side opposite the DLP side is alternatively referred to as the "Scribe Side". In this embodiment the motor scribe line will be generally in alignment with the circumferential mid-point of gauge pad 133. Shoulder lateral cutters 122 have what is termed in the art as a positive side rake in that they are skewed outward towards the periphery of the bit at an angle. In the case of shoulder lateral cutters 122 the angle is typically ten to fifty five degrees. Circumferential cone cutters 110 are mounted on blades 2, 3, and 4. Circumferential cone cutters 110 exhibit traditional neutral to positive side rake values in the range of zero degrees to twenty five degrees. Nose cutters 111 are mounted on blades 1, 2, 3, and 4 and exhibit traditional neutral to positive side rake values in the range of zero degrees to twenty five degrees. Circumferential shoulder cutters 112 are mounted on blades 1, 2, and 4 and exhibit traditional neutral to positive side rake values in the range of zero degrees to twenty five degrees. The side rake values of the lateral cone cutters 120 and lateral shoulder cutters 122 enable these cutters to more effectively cut laterally in response to cyclical force pulses from DLP 101. In this view gauge pad 132 is set with gauge cutter 113, gauge pad 133 is set with gauge cutter 113, and gauge pad 134 is also set with gauge cutter 113. In certain embodiments, the gauge pad 131 may also be set with a gauge cutter (not shown).

Figure 2:
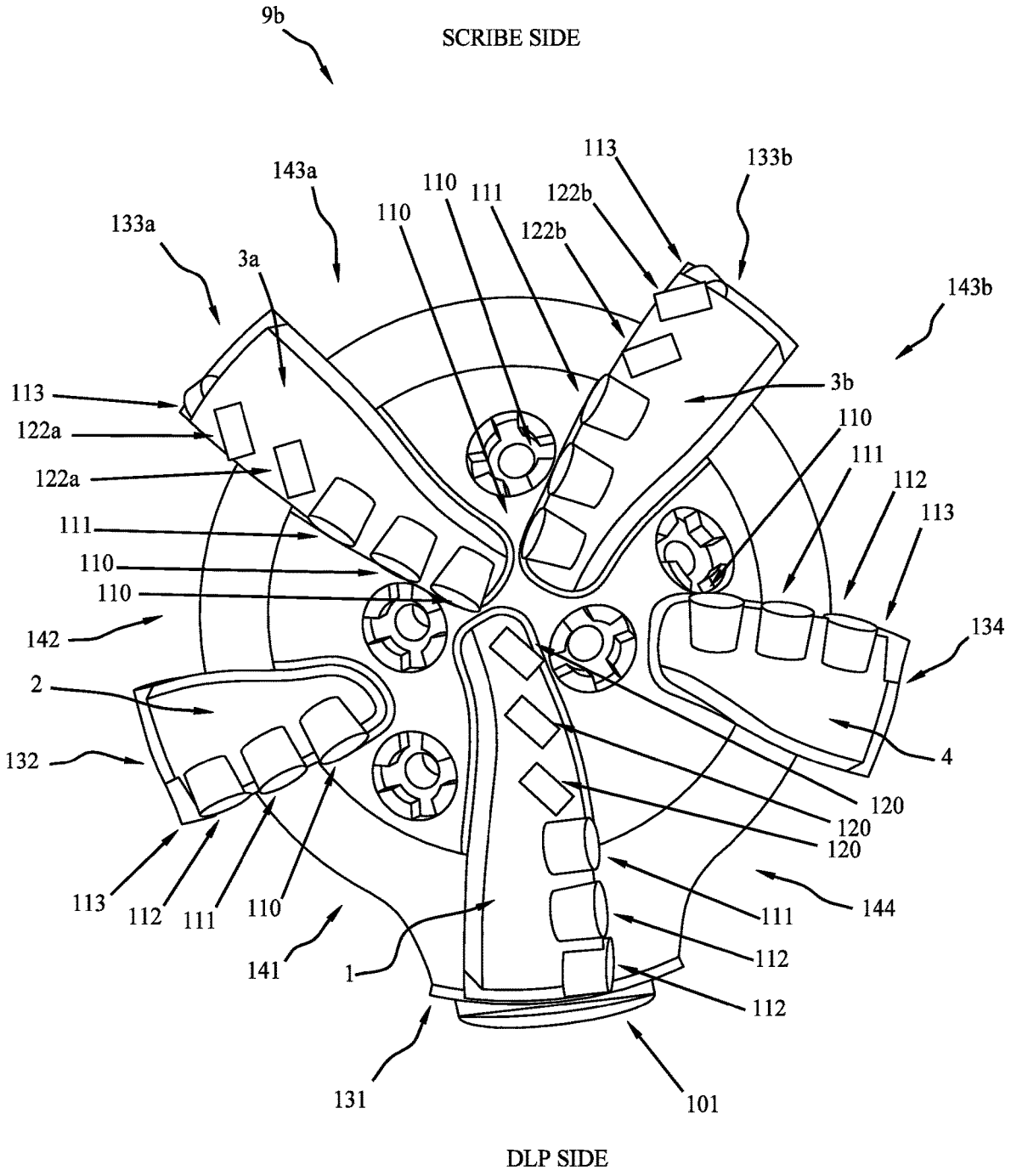
FIG. 2 provides a face plan view of a five blade drill bit incorporating lateral cutters on the cone area of the bit on the blade that is generally on the DLP side of the bit and lateral cutters on the shoulder area of the bit on the two blades that are generally opposite the DLP side of the bit.

FIG. 2 is a face view of one embodiment of the technology of the application. FIG. 2 shows an activated Dynamic Lateral Pad (DLP) in alignment with gauge pad 131 of five blade drill bit 9*b*. DLP 101 is shown with exaggerated extension for clarity. Cone lateral cutters 120 are mounted in the cone area of blade 1 generally on the same side of the bit as the DLP 101. The cone lateral cutters 120 have what is termed in the art as a "negative side rake" in that they are skewed inward towards the center of the bit typically three degrees to fifty degrees. Shoulder lateral cutters 122*a* and 122*b* are mounted in the shoulder area of the bit on blades 3*a* and 3*b* generally opposite the side of the bit as the DLP 101. In the technology of this application this side opposite the DLP side is alternatively referred to as the "Scribe Side". In this embodiment the motor scribe line will be generally in alignment with the circumferential mid-point of junk slot 143*a*. Shoulder lateral cutters 122 have what is termed in the art as a positive side rake in that they are skewed outward towards the periphery of the bit at an angle. In the case of shoulder lateral cutters 122*a* and 122*b* the angle is typically ten to fifty five degrees. The siderake angles of the shoulder lateral cutters may vary either within a single blade 3*a* or 3*b* or between blades 3*a* and 3*b*. In other words, the shoulder lateral cutters 122*a*, 122*b* may have different rake angles for the different blades 3*a*, 3*b*. Additional, with this and other embodiments, the cutters on a particular blade, such as cutters 122*a* may be configured with different rake angles. Circumferential cone cutters 110 are mounted on blades 2, 3*a*, 3*b* and 4. Circumferential cone cutters 110 exhibit traditional neutral to positive side rake values in the range of zero degrees to twenty five degrees. Nose cutters 111 are mounted on blades 1, 2, 3*a*, 3*b*, and 4 and exhibit traditional neutral to positive side rake values in the range of zero degrees to twenty five degrees. Circumferential shoulder cutters 112 are mounted on blades 1, 2, and 4 and exhibit traditional neutral to positive side rake values in the range of zero degrees to twenty five degrees. The side rake values of the lateral cone cutters 120 and lateral shoulder cutters 122*a* and 122*b* enable these cutters to more effectively cut laterally in response to cyclical force pulses from DLP 101. In this view gauge pad 132 is set with gauge cutter 113, gauge pad 133*a* is set with gauge cutter 113, gauge pad 133*b* is set with gauge cutter 113, and gauge pad 134 is also set with gauge cutter 113. As described above, gauge pad 131 may also be set with a gauge cutter (not shown) in certain embodiments.

Figure 3:
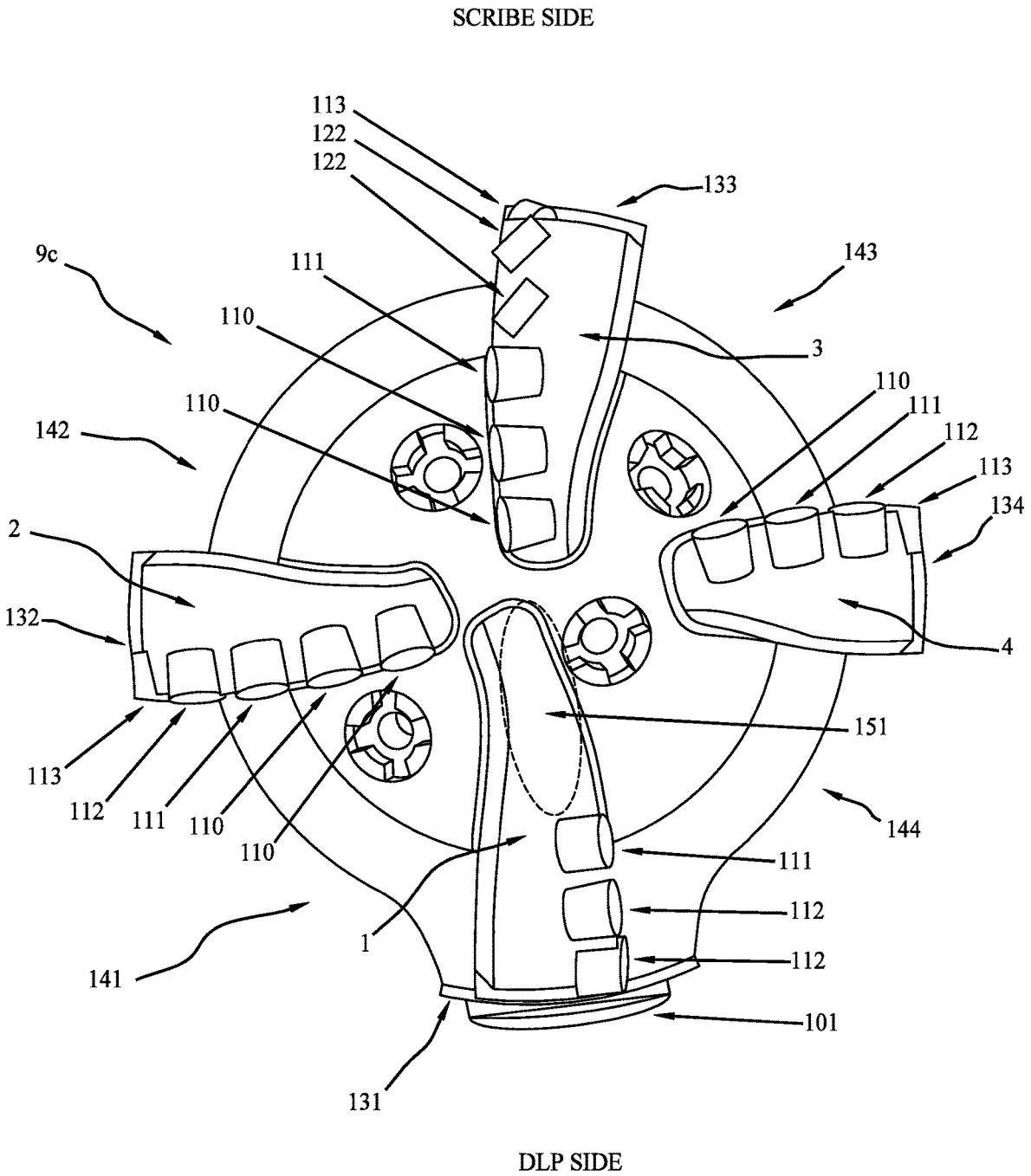
FIG. 3 provides a face plan view of a four blade drill bit incorporating an area void of cutters in the cone area of the bit on the blade that is generally on the DLP side of the bit and lateral cutters on the shoulder area of the bit on the blade that is generally opposite the DLP side of the bit.

FIG. 3 is a face view of one embodiment of the technology of the application. FIG. 3 shows an activated Dynamic Lateral Pad (DLP) in alignment with gauge pad 131 of four blade drill bit 9*c*. DLP 101 is shown with exaggerated extension for clarity. Cone area 151 of blade 1 is devoid of cutters generally on the same side of the bit as the DLP 101. By laying out the cutting structure to leave cone area 151 of blade 1 devoid of cutters resistance to lateral translation towards the Scribe Side in response to cyclical impulses from DLP 101 is reduced. Shoulder lateral cutters 122 are mounted in the shoulder area of the bit on blade 3 generally opposite the side of the bit as the DLP 101. In this embodiment the motor scribe line will be generally in alignment with the circumferential mid-point of gauge pad 133. Shoulder lateral cutters 122 have what is termed in the art as a positive side rake in that they are skewed outward towards the periphery of the bit at an angle. In the case of shoulder lateral cutters 122 the angle is typically ten to fifty five degrees. Circumferential cone cutters 110 are mounted on blades 2, 3, and 4. Circumferential cone cutters 110 exhibit traditional neutral to positive side rake values in the range of zero degrees to twenty five degrees. Nose cutters 111 are mounted on blades 1, 2, 3, and 4 and exhibit traditional neutral to positive side rake values in the range of zero degrees to twenty five degrees. Circumferential shoulder cutters 112 are mounted on blades 1, 2, and 4 and exhibit traditional neutral to positive side rake values in the range of zero degrees to twenty five degrees. The side rake values of the lateral shoulder cutters 122 enable these cutters to more effectively cut laterally in response to cyclical force pulses from DLP 101. In this view gauge pad 132 is set with gauge cutter 113, gauge pad 133 is set with gauge cutter 113, and gauge pad 134 is also set with gauge cutter 113. As described above, gauge pad 131 may also be set with a gauge cutter (not shown) in certain embodiments.

Figure 4:
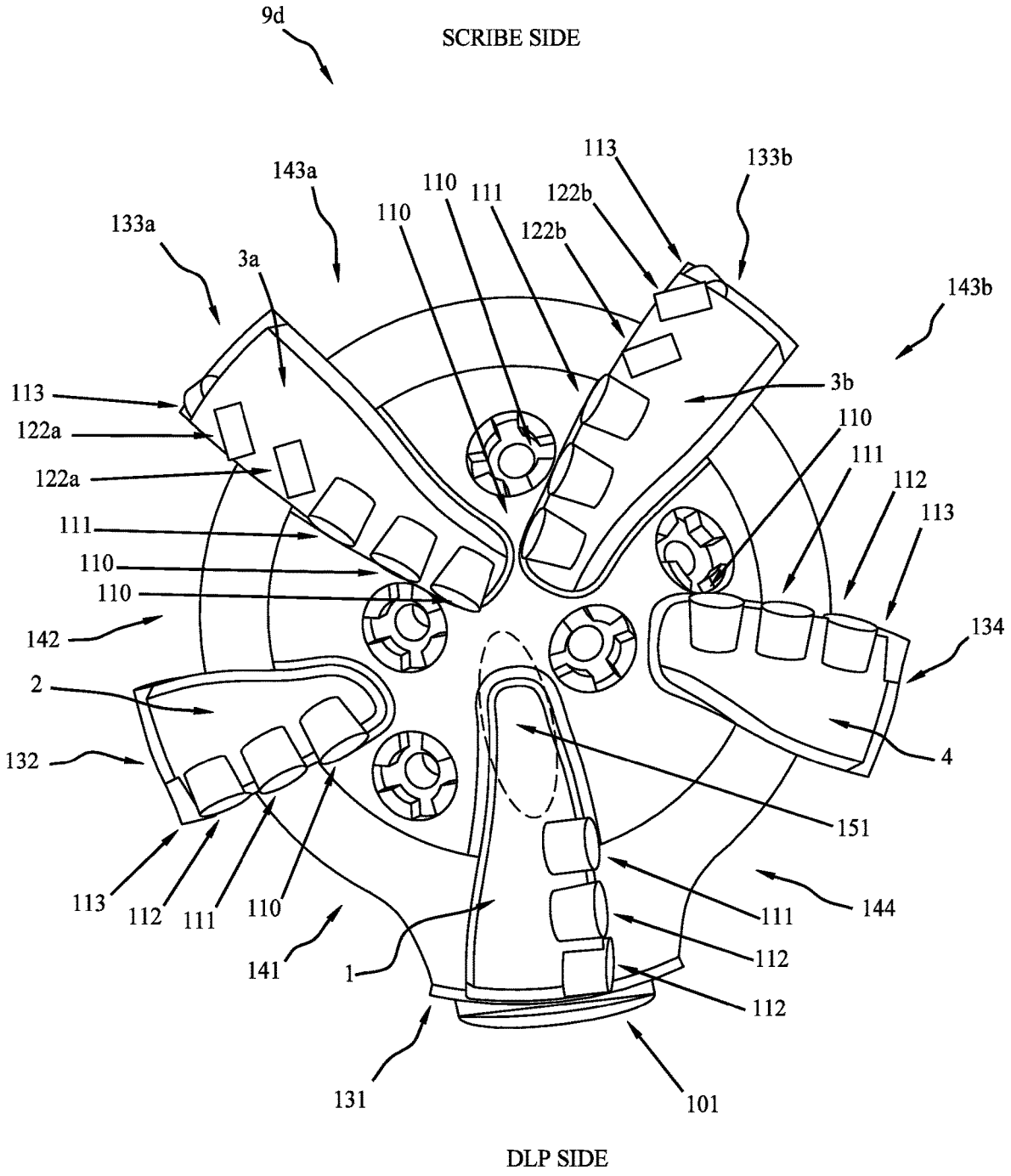
FIG. 4 provides a face plan view of a five blade drill bit incorporating an area void of cutters on the cone area of the bit on the blade that is generally on the DLP side of the bit and lateral cutters on the shoulder area of the bit on the two blades that are generally opposite the DLP side of the bit.

FIG. 4 is a face view of one embodiment of the technology of the application. FIG. 4 shows an activated Dynamic Lateral Pad (DLP) in alignment with gauge pad 131 of five blade drill bit 9*d*. DLP 101 is shown with exaggerated extension for clarity. Cone area 151 of blade 1 is devoid of cutters generally on the same side of the bit as the DLP 101. By laying out the cutting structure to leave cone area 151 of blade 1 devoid of cutters resistance to lateral translation towards the Scribe Side in response to cyclical impulses from DLP 101 is reduced. Shoulder lateral cutters 122*a* and 122*b* are mounted in the shoulder area of the bit on blades 3*a* and 3*b* generally opposite the side of the bit as the DLP 101. In the technology of this application this side opposite the DLP side is alternatively referred to as the "Scribe Side". In this embodiment the motor scribe line will be generally in alignment with the circumferential mid-point of junk slot 143*a*. Shoulder lateral cutters 122*a* and 122*b* have what is termed in the art as a positive side rake in that they are skewed outward towards the periphery of the bit at an angle. In the case of shoulder lateral cutters 122*a* and 122*b* the angle is typically ten to fifty five degrees. As described above the rake angles for cutters 122*a* on a single blade 3*a* may vary in certain embodiments. Also, the rake angles for cutters 122*a* and 122*b* on blades 3*a*, 3*b* may be different. Circumferential cone cutters 110 are mounted on blades 2, 3*a*, 3*b* and 4. Circumferential cone cutters 110 exhibit traditional neutral to positive side rake values in the range of zero degrees to twenty five degrees. Nose cutters 111 are mounted on blades 1, 2, 3*a*, 3*b*, and 4 and exhibit traditional neutral to positive side rake values in the range of zero degrees to twenty five degrees. Circumferential shoulder cutters 112 are mounted on blades 1, 2, and 4 and exhibit traditional neutral to positive side rake values in the range of zero degrees to twenty five degrees. The side rake values of the lateral shoulder cutters 122*a* and 122*b* enable these cutters to more effectively cut laterally in response to cyclical force pulses from DLP 101. In this view gauge pad 132 is set with gauge cutter 113, gauge pad 133*a* is set with gauge cutter 113, gauge pad 133*b* is set with gauge cutter 113, and gauge pad 134 is also set with gauge cutter 113. As described above, gauge pad 131 may also be set with a gauge cutter (not shown) in certain embodiments.

Figure 5:
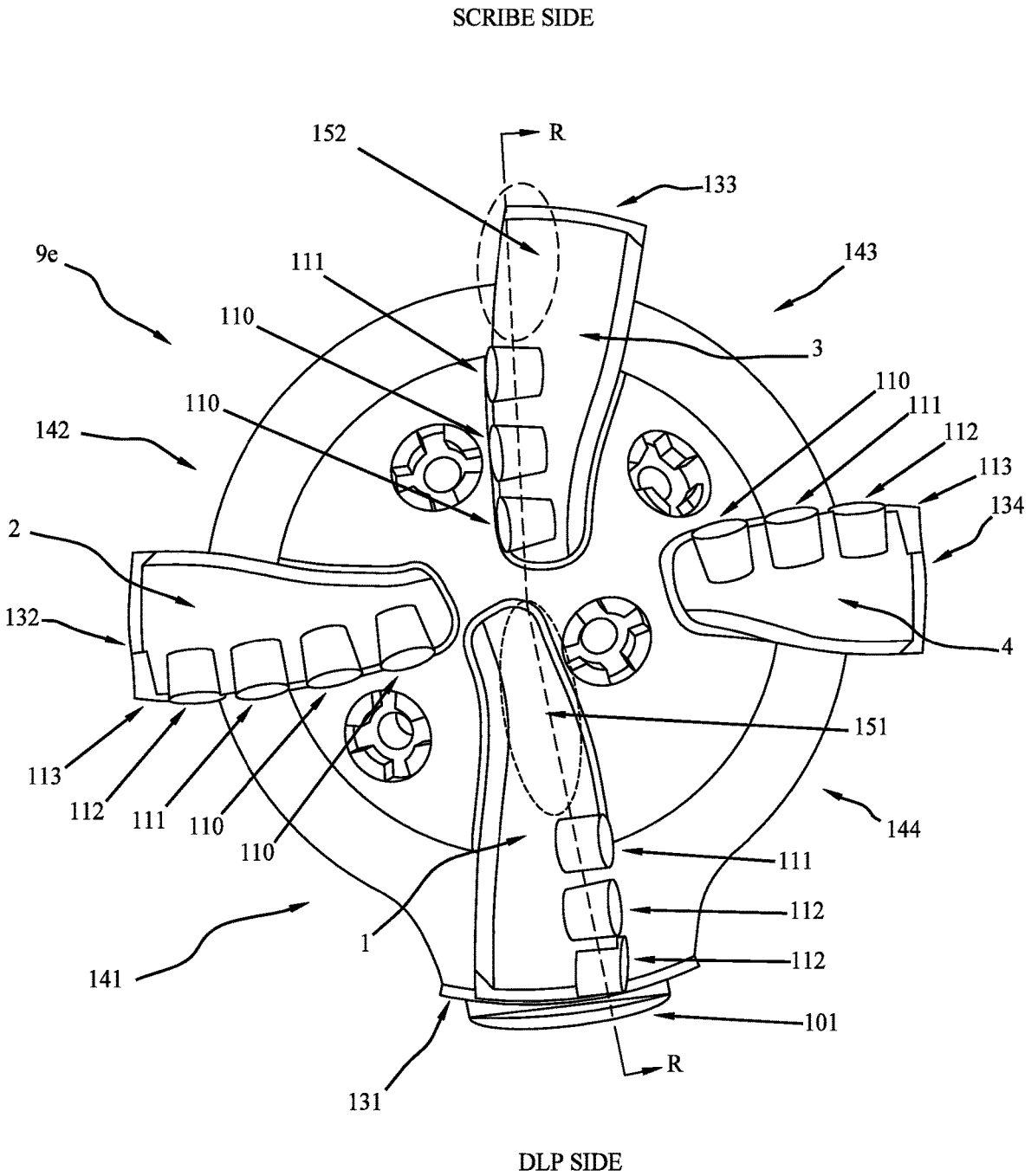
FIG. 5 provides a face plan view of a four blade drill bit incorporating an area void of cutters in the cone area of the bit on the blade that is generally on the DLP side of the bit and an area void of cutters on the shoulder area of the bit on the blade that is generally opposite the DLP side of the bit.

FIG. 5 is a face view of one embodiment of the technology of the application. FIG. 5 shows an activated Dynamic Lateral Pad (DLP) in alignment with gauge pad 131 of four blade drill bit 9*e*. DLP 101 is shown with exaggerated extension for clarity. Cone area 151 of blade 1 is devoid of cutters generally on the same side of the bit as the DLP 101. By laying out the cutting structure to leave cone area 151 of blade 1 devoid of cutters resistance to lateral translation towards the Scribe Side in response to cyclical impulses from DLP 101 is reduced. Shoulder area 152 of blade 3 is devoid of cutters generally opposite the side of the bit as the DLP 101. By laying out the cutting structure to leave shoulder area 152 of blade 3 devoid of cutters resistance to lateral translation towards the Scribe Side in response to cyclical impulses from DLP 101 is reduced. In this embodiment the motor scribe line will be generally in alignment with the circumferential mid-point of gauge pad 133. Circumferential cone cutters 110 are mounted on blades 2, 3, and 4. Circumferential cone cutters 110 exhibit traditional neutral to positive side rake values in the range of zero degrees to twenty five degrees. Nose cutters 111 are mounted on blades 1, 2, 3, and 4 and exhibit traditional neutral to positive side rake values in the range of zero degrees to twenty five degrees. Circumferential shoulder cutters 112 are mounted on blades 1, 2, and 4 and exhibit traditional neutral to positive side rake values in the range of zero degrees to twenty five degrees. In this view gauge pad 132 is set with gauge cutter 113, and gauge pad 134 is also set with gauge cutter 113. As described above, gauge pad 131 may also be set with a gauge cutter (not shown) in certain embodiments. An alternative (not shown) to FIG. 5 could have lateral cone cutters such as are shown in FIG. 1 and FIG. 2 while being devoid of shoulder lateral cutters as shown in FIG. 5.

Figure 6:
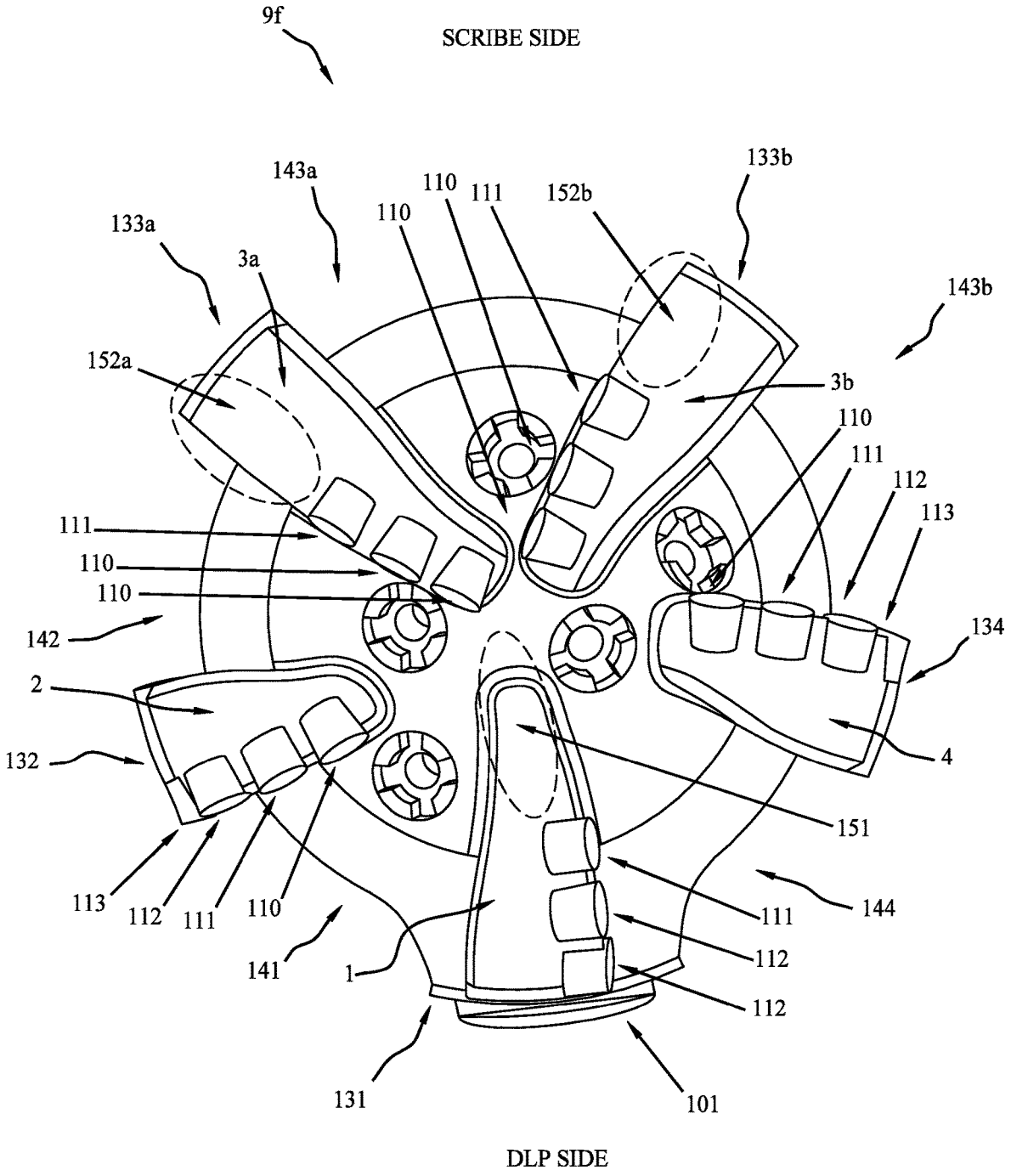
FIG. 6 provides a face plan view of a five blade drill bit incorporating an area void of cutters in the cone area of the bit on the blade that is generally on the DLP side of the bit and areas void of cutters on the shoulder of the bit on the blades that are generally opposite the DLP side of the bit.

FIG. 6 is a face view of one embodiment of the technology of the application. FIG. 6 shows an activated Dynamic Lateral Pad (DLP) in alignment with gauge pad 131 of five blade drill bit 9*f*. DLP 101 is shown with exaggerated extension for clarity. Cone area 151 of blade 1 is devoid of cutters generally on the same side of the bit as the DLP 101. By laying out the cutting structure to leave cone area 151 of blade 1 devoid of cutters resistance to lateral translation towards the Scribe Side in response to cyclical impulses from DLP 101 is reduced. Shoulder areas 152*a* and 152*b* of blades 3*a* and 3*b* are devoid of cutters generally opposite the side of the bit as the DLP 101. By laying out the cutting structure to leave shoulder areas 152*a* and 152*b* of blades 3*a* and 3*b* devoid of cutters resistance to lateral translation towards the Scribe Side in response to cyclical impulses from DLP 101 is reduced. In this embodiment the motor scribe line will be generally in alignment with the circumferential mid-point of junk slot 143*a*. Circumferential cone cutters 110 are mounted on blades 2, 3*a*, 3*b* and 4. Circumferential cone cutters 110 exhibit traditional neutral to positive side rake values in the range of zero degrees to twenty five degrees. Nose cutters 111 are mounted on blades 1, 2, 3*a*, 3*b*, and 4 and exhibit traditional neutral to positive side rake values in the range of zero degrees to twenty five degrees. Circumferential shoulder cutters 112 are mounted on blades 1, 2, and 4 and exhibit traditional neutral to positive side rake values in the range of zero degrees to twenty five degrees. In this view gauge pad 132 is set with gauge cutter 113, and gauge pad 134 is also set with gauge cutter 113. As described above, gauge pad 131 may also be set with a gauge cutter (not shown) in certain embodiments. An alternative (not shown) to FIG. 6 could have lateral cone cutters such as are shown in FIG. 1 and FIG. 2 while being devoid of shoulder lateral cutters as shown in FIG. 6.

Figure 7:
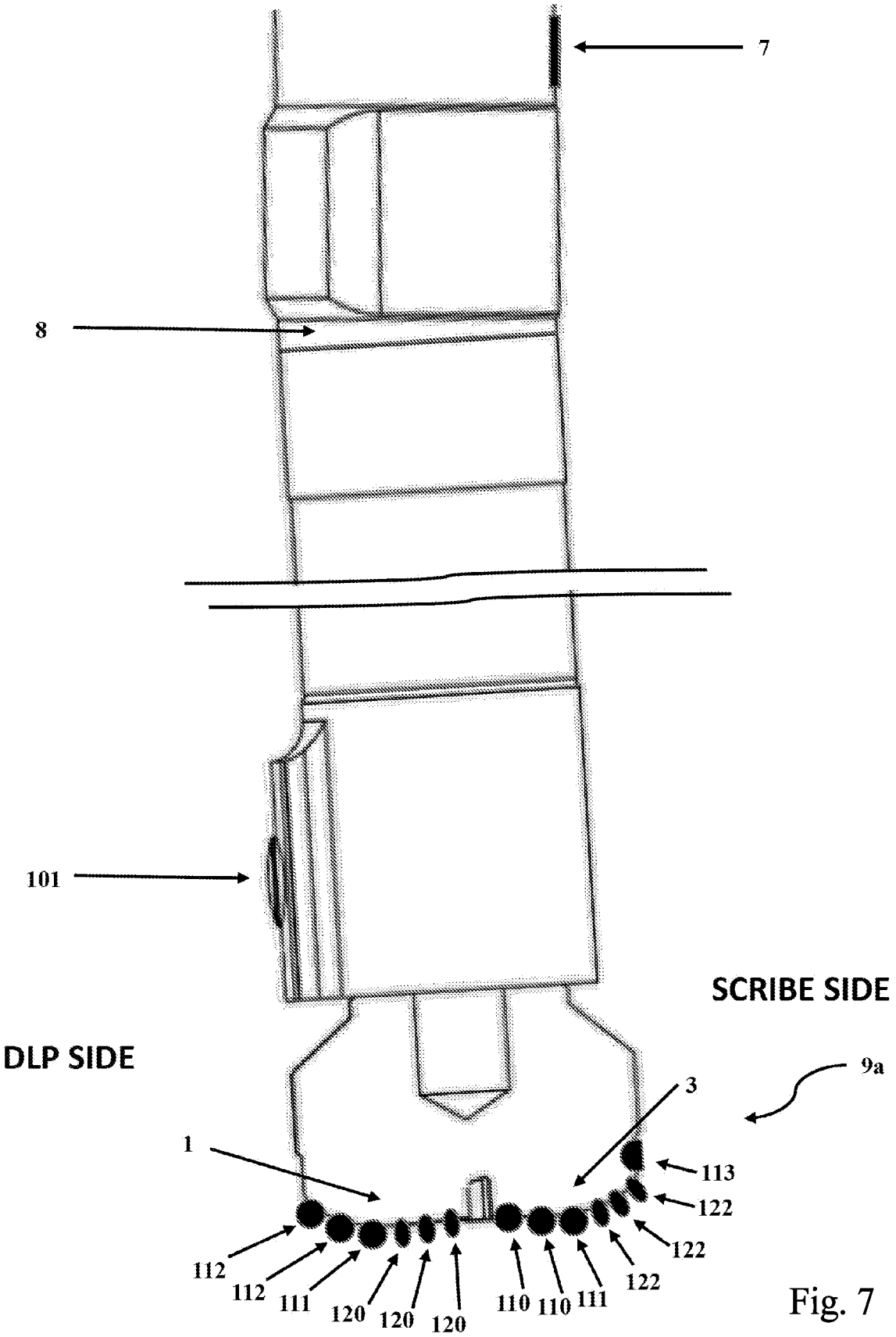
FIG. 7 provides a cross sectioned side view of the drill bit of FIG. 1.

FIG. 7 is a cross sectional side view of drill bit 9*a* of FIG. 1 taken generally at Q-Q. FIG. 7 shows scribe line 7 on the bottomhole assembly housing above bit 9*a* generally opposite bend angle 8. FIG. 7 shows circumferential shoulder cutters 112 on the shoulder of the DLP side of the bit on blade 1. Circumferential nose cutters 111 are shown on blades 1 and 3. Lateral cone cutters 120 are shown in the cone area of blade 1. Lateral shoulder cutters 122 are shown on blade 3. Gauge cutter 113 is shown on the gauge section of blade 3. When DLP 101 is cycled with each rotation of the drill bit, force from engagement of DLP 101 with borehole wall (not shown) causes lateral cone cutters 120 and lateral shoulder cutters 122 to shear laterally into the cone and shoulder areas in the lateral direction of scribe line 7 to better enable the lateral translation of the bit in response to cyclical force from DLP 101.

Figure 8:
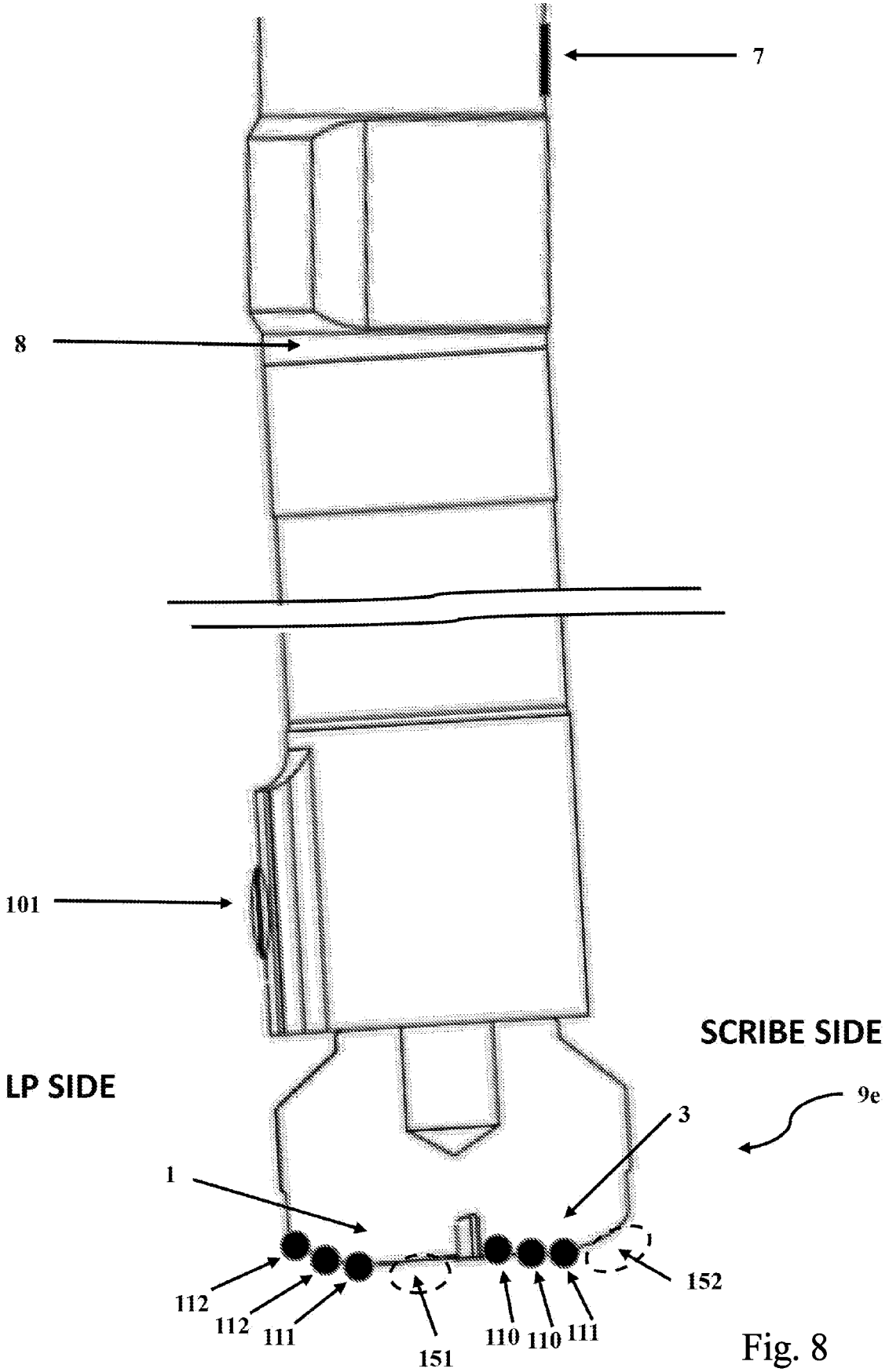
FIG. 8 provides a cross sectioned side view of the drill bit of FIG. 5.

FIG. 8 is a cross sectional side view of drill bit 9*e* of FIG. 5 taken generally at R-R. FIG. 8 shows scribe line 7 on the bottom hole assembly housing above bit 9*e* opposite bend angle 8. FIG. 8 shows circumferential shoulder cutters 112 on the shoulder of the DLP side of the bit on blade 1. Circumferential nose cutters 111 are shown on blades 1 and 3. Cone area 151 of blade 1 is devoid of cutters on the same side of the bit as the DLP 101. By laying out the cutting structure to leave cone area 151 of blade 1 devoid of cutters resistance to lateral translation towards the Scribe Side in response to cyclical impulses from DLP 101 is reduced. Shoulder area 152 of blade 3 is devoid of cutters generally opposite the side of the bit as the DLP 101. By laying out the cutting structure to leave shoulder area 152 of blade 3 devoid of cutters resistance to lateral translation towards the Scribe Side in response to cyclical impulses from DLP 101 is reduced. When DLP 101 is cycled with each rotation of the drill bit, force from engagement of DLP 101 with borehole wall (not shown) causes lateral translation of the bit 9*e* towards the Scribe Side. Areas 151 and 152 being devoid of cutters better enable the lateral translation of the bit in response to cyclical force from DLP 101.

Figure 9:
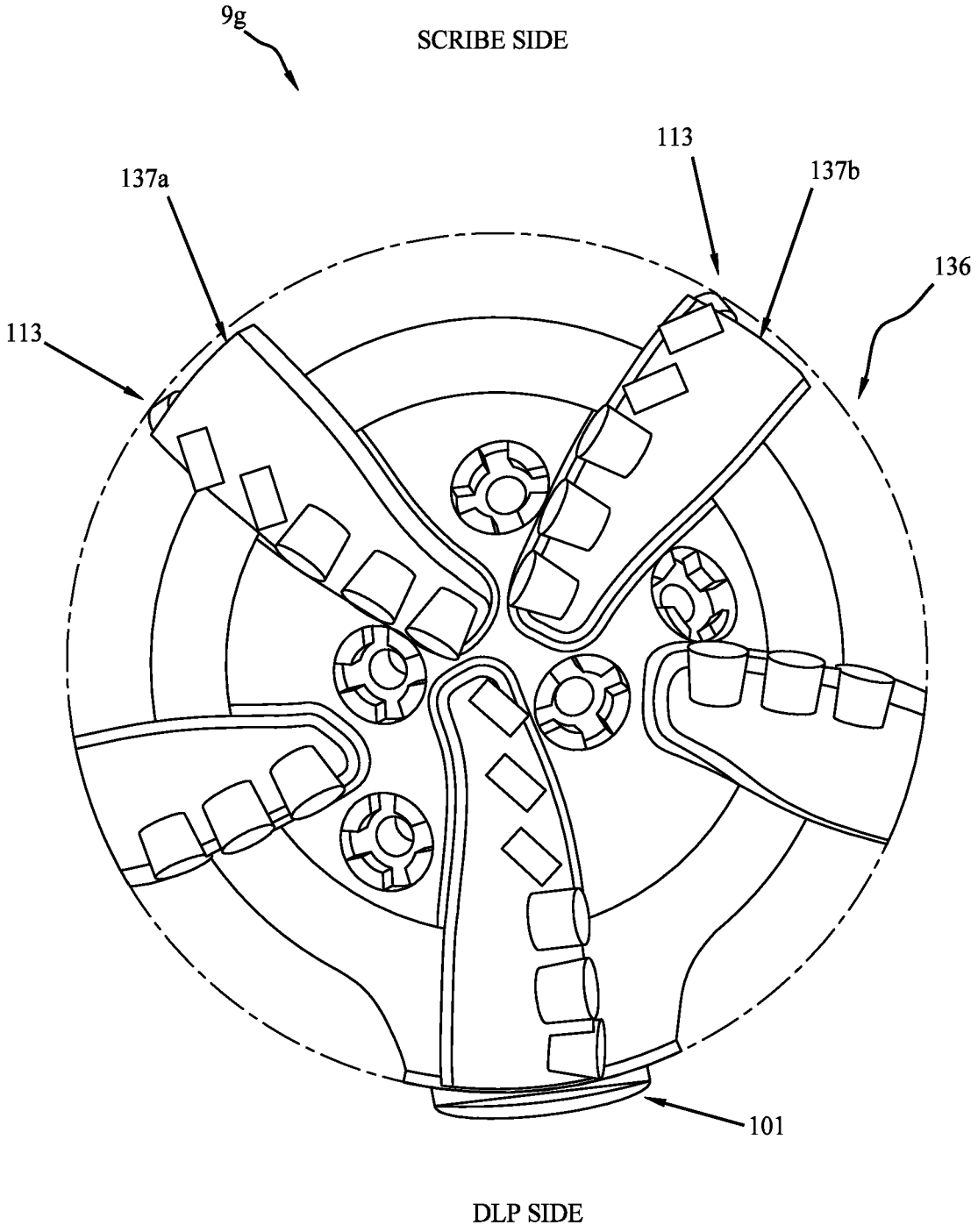
FIG. 9 provides a face view of the bit face of FIG. 5 with the gauge pads generally opposite the DLP undersized according to a teaching of the present application.

FIG. 9 shows bit 9*g* which is a modified face view of the bit 9*b* of FIG. 2. In this embodiment of the technology of the application gauge pads 133*a* and 133*b* of bit 9*b* have been reduced in circumference below full hole gauge diameter 136 to reduced diameter shown at 137*a* and 137*b*. By reducing the diameter of the two pads 137*a* and 137*b* generally on the Scribe Side of the bit 9*g* resistance to lateral translation of bit 9*g* in response to cyclical force from activated DLP 101 is reduced. On the bit 9*g* pads 137*a* and 137*b* are set with PDC gauge cutters 113 that are at or near full hole gauge diameter to more aggressively shear the borehole wall (not shown) on the Scribe Side of bit 9*g*.

Figure 10:
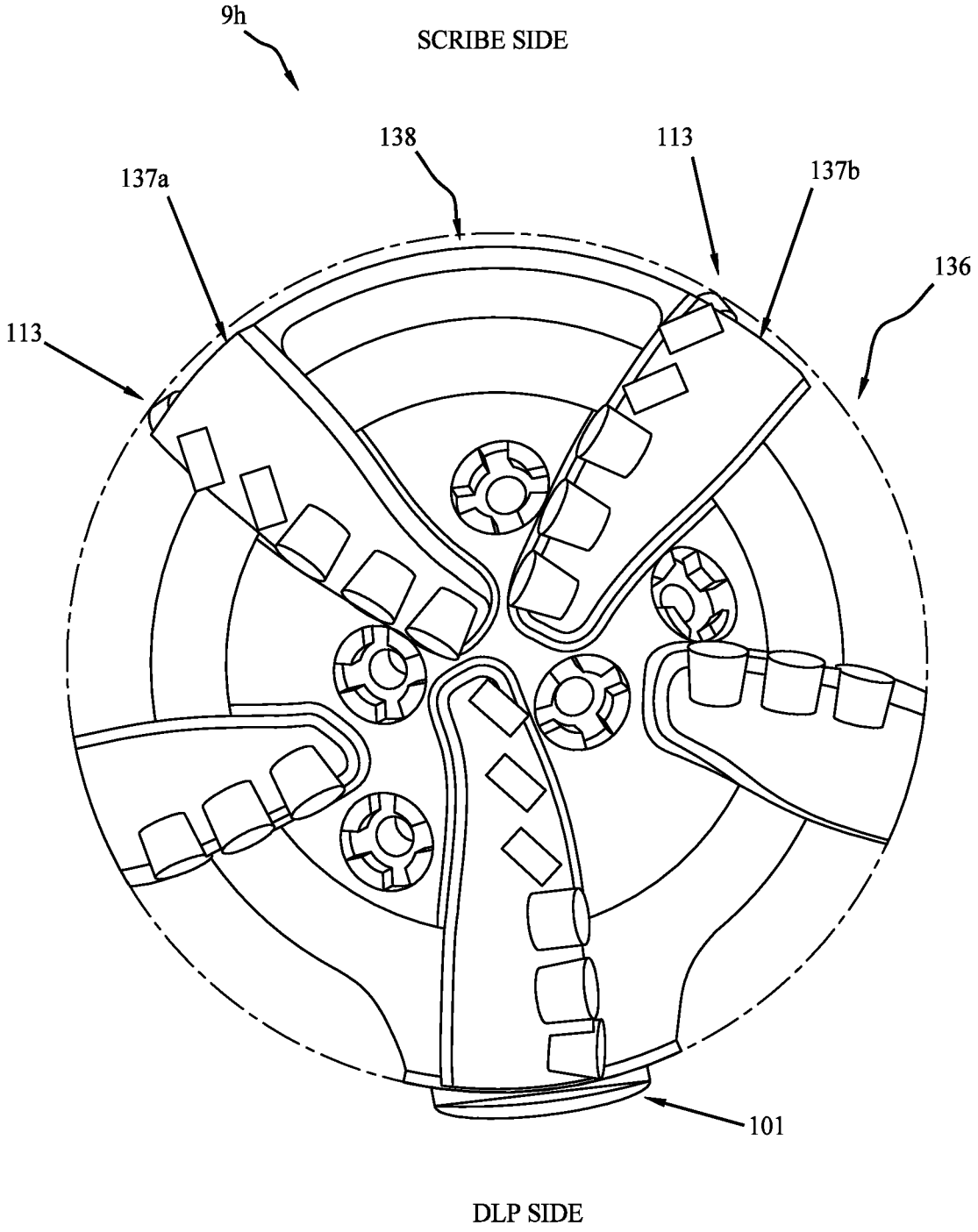
FIG. 10 shows a modification of the bit of FIG. 9 incorporating the addition of a smooth gauge pad spanning the junk slot generally on the Scribe Side of the bit.

FIG. 10 shows bit 9*h* which is a modification of the bit 9*g* of FIG. 9 Bit 9*h* incorporates the addition of a smooth gauge pad 138 spanning the junk slot on the Scribe Side of the bit. This smooth gauge pad is intended to further limit the extent of lateral translation of the bit. The smooth gauge pad 138 may be equally undersized to the undersized gauge pads 137*a* or 137*b* or may be closer to full hole gauge diameter 136. Smooth gauge pad 138 may be hardfaced with a lower tungsten carbide content hardfacing (not shown) as discussed previously.

Figure 11:
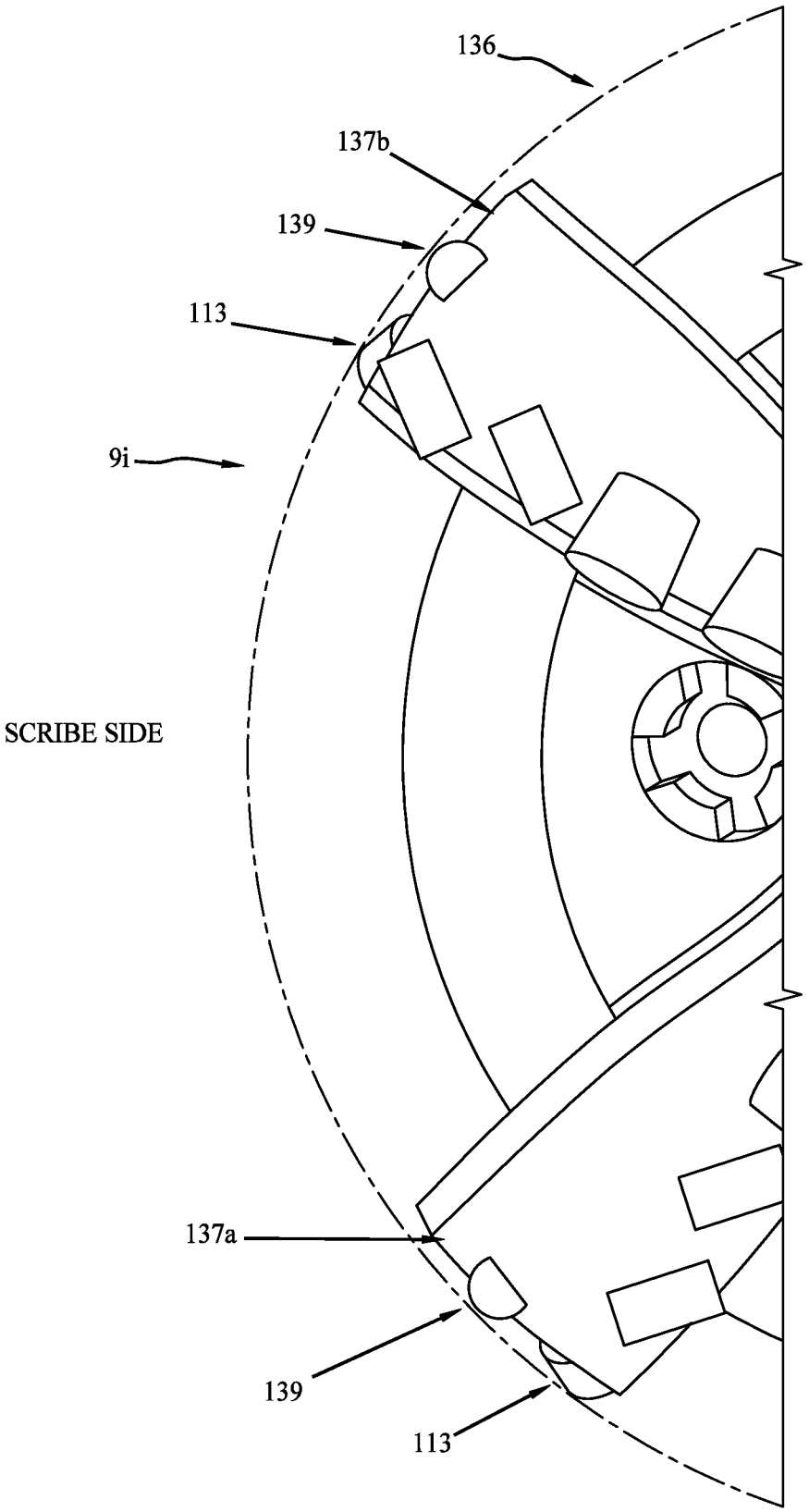
FIG. 11 shows a detail of the Scribe Side bit of FIG. 9 modified to incorporate dome topped limiters on the gauge pads generally on the Scribe Side of the bit.

FIG. 11 shows a modified bit detail 9*i* of the Scribe Side of bit 9*g* of FIG. 9. This modification incorporates dome topped limiters 139, either tungsten carbide or PDC or other materials as known in the art, on the gauge pads 137*a* and 137*b* generally on the Scribe Side of the bit. Dome topped limiters 139 are exposed slightly undergage in comparison to gauge cutters 113 and full hole circumference 136. This differential in exposure allows the dome topped limiters 139 to limit the extent of lateral translation of the bit 9*i* in response to cyclical force from DLP 101 (not shown).

Figure 12:
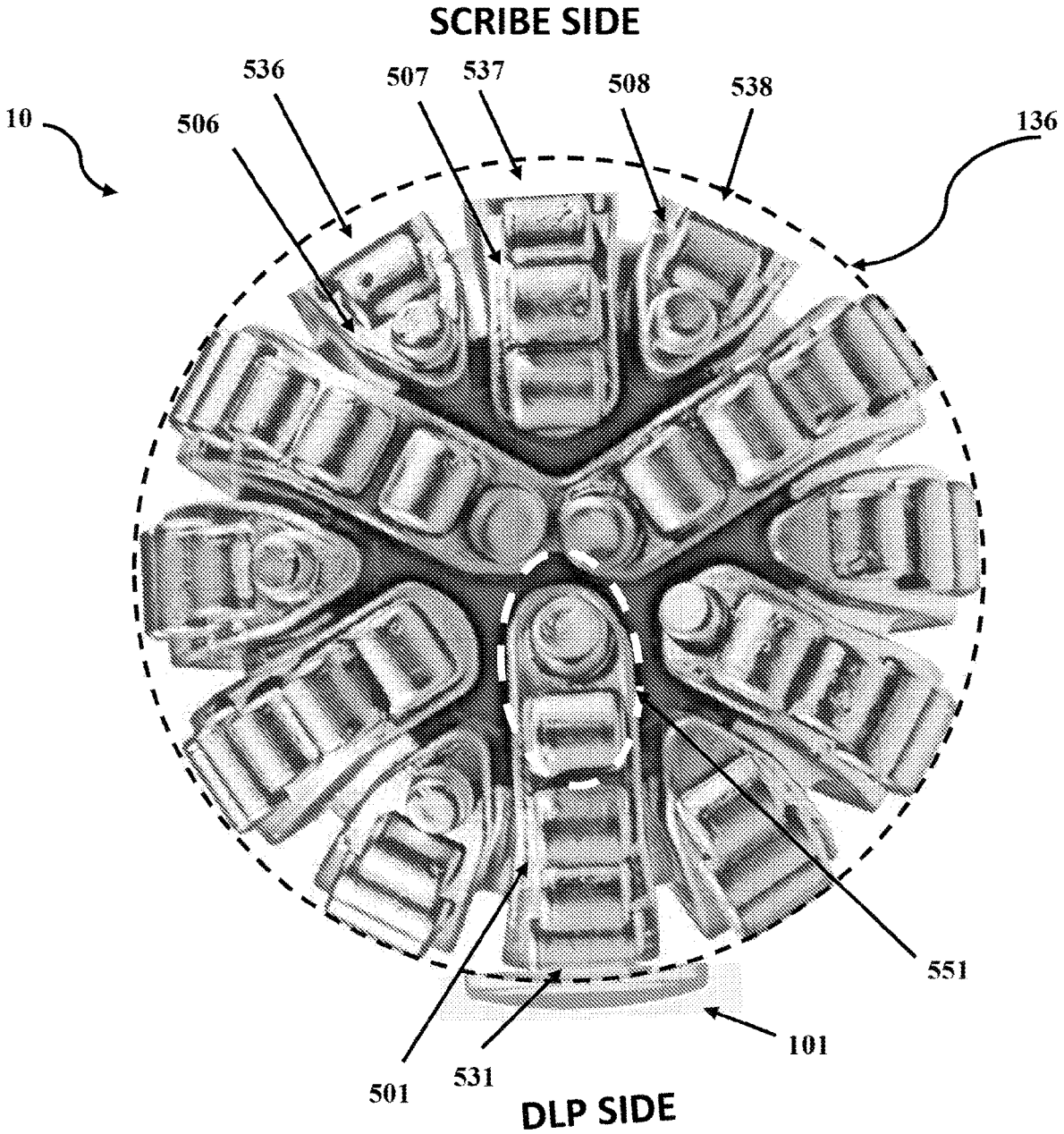
FIG. 12 provides a face plan view of a diamond impregnated bit incorporating teachings of this application.

FIG. 12 provides a face plan view of a type of diamond impregnated bit 10 incorporating teachings of this application. FIG. 12 shows an activated Dynamic Lateral Pad (DLP) in alignment with gauge pad 531 of twelve blade diamond impregnated drill bit 10. DLP 101 is shown with exaggerated extension for clarity. In this view the three blades 506, 507, and 508 generally on the Scribe Side of bit 10 have been truncated on the outer shoulder. Corresponding gauge pads 536, 537, and 538 are under full hole gauge diameter 136 according to the teachings of this invention.

Although not shown in FIG. 12 blade 501 generally on the DLP side of the bit 10 could be modified to eliminate cone cutters within circle 551. In addition, although not shown, further cutters could be removed from shoulder area of blades 506, 507, and 508.

Figure 13:
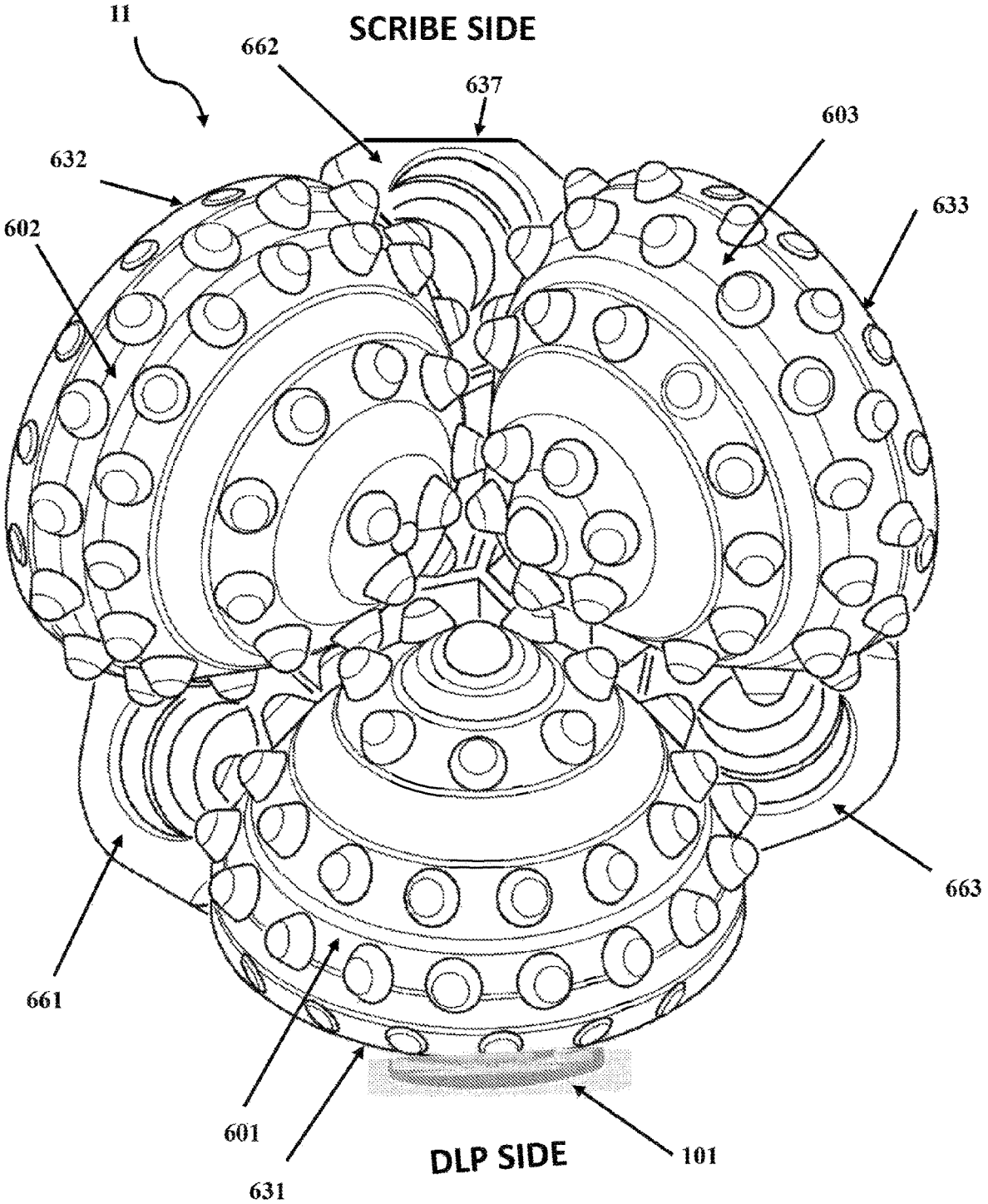
FIG. 13 provides a face plan view of a roller cone bit incorporating teachings of this application.

FIG. 13 provides a face plan view of a roller cone drill bit 11 incorporating teachings of this application. FIG. 13 shows an activated Dynamic Lateral Pad (DLP) in alignment with gauge outer periphery 631 of cone number one, 601, of drill bit 11. DLP 101 is shown with exaggerated extension for clarity. In this embodiment nozzle bosses 661 and 663 are shown with their full, original outer radius. Nozzle boss 662, generally on the Scribe Side of roller cone drill bit 11 is shown with material removed in the form of flatted area 637. The purpose of flatting nozzle boss 662 is to keep it from interfering with lateral translation of roller cone drill bit 11 when DLP 101 is activated. FIG. 13 also shows outer peripheral areas 631 on cone 601, 632 on cone 602, and 633 on cone 603. Although not shown in FIG. 11 the outer peripheral areas 632 or 633 or both may by reduced in outer diameter to further allow for the lateral translation of roller cone drill bit 11 in response to cyclical force from activated DLP 101.

Figure 14:
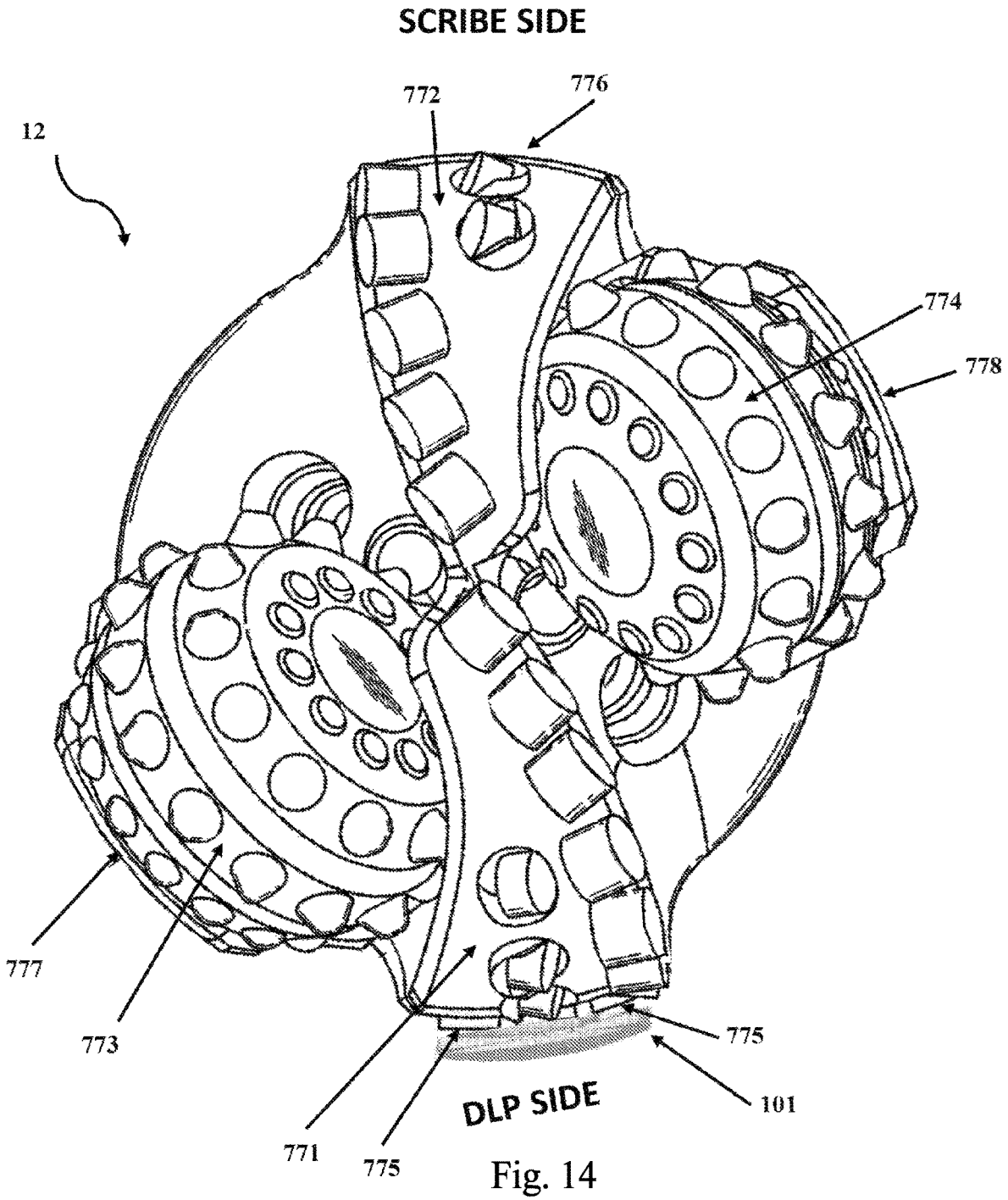
FIG. 14 provides a face plan view of a hybrid PDC/roller cone bit incorporating teachings of this application.

FIG. 14 provides a face plan view of a hybrid PDC/roller cone drill bit 12 incorporating teachings of this application. FIG. 14 shows an activated Dynamic Lateral Pad (DLP) in general alignment with gauge cutters 775 adjacent to blade 771 of drill bit 12. DLP 101 is shown with exaggerated extension for clarity. In this embodiment gauge cutters have been removed from area 776 adjacent to blade 772 generally on the Scribe Side of hybrid PDC/roller cone drill bit 12. The purpose of removing the gauge cutters from are 776 is to keep them from interfering with lateral translation of hybrid PDC/roller cone drill bit 12 when DLP 101 is activated. FIG. 14 also shows outer arm peripheral areas 777 and 778 adjacent to cones 773 and 774 respectively. Although not shown in FIG. 14, according to the technologies of this application, the shoulder cutters of blade 772 may be sideraked aggressively towards the outer periphery of bit 12. Alternatively, (also not shown) the shoulder of blade 772 may be left devoid of cutters. Both of these alternatives are meant to further allow for the lateral translation of hybrid PDC/roller cone drill bit 12 in response to cyclical force from activated DLP 101. Also in reference to FIG. 14 cone cutters of blade 771 may be negatively, neutrally, or positively sideraked in certain embodiments.

The bit designer may choose from the technologies disclosed in this application in creating a specific laterally oriented cutting structure. For example on a PDC bit DLP cone side and Scribe Side shoulder areas devoid of cutters will allow for greater lateral translation than these same areas set with lateral cutters.

In one variation on a bit with an odd number of blades one of the Scribe Side shoulder areas may be set with lateral shoulder cutters while the other Scribe Side shoulder area may be left devoid of cutters.

The PDC bit examples shown have been of four and five blade bits but the technologies of this application can be equally applied to bits with three, six, seven, eight, nine or more blades.

The examples shown in this application have shown a single DLP however the technologies may be applied to drill bit bottom hole assemblies utilizing two DLPs as described in the "Drilling Machine" application.

The examples shown in the figures have blade 1 in alignment with the DLP. In certain embodiments, the design may have a single DLP aligned with a junk slot opposite the Scribe Side of the bit and configure the cone cutters on the blades adjacent to the said junk slot either set with lateral cone cutters, or devoid of cone cutters as taught previously in the technology of this application.

The designer is equally free to choose gauge configurations as described in this application, or he may choose to employ a standard gauge configuration depending on cutting structure modifications alone to allow for the desired amount of lateral translation. In the instance of the gauge configuration wherein the gauge hardfacing on the Scribe Side of the bit is of a lower tungsten carbide content the lateral translation of the bit in response to cyclical force from the DLP will increase as the Scribe Side gauge wears down creating less resistance to lateral translation.

We claim:

1. A directional drilling apparatus configured to attach to a drill string, the directional drilling apparatus comprising:

a recess formed in an axially extending sidewall defining a volume;

a dynamic lateral pad designed to laterally move with respect to the volume from a retracted position to an extended position over each rotation of a drill bit such that, when in the extended position, a surface of the dynamic lateral pad is configured to engage a sidewall of a wellbore; and the drill bit that is mounted in a fixed circumferential relationship with the dynamic lateral pad, wherein the drill bit comprises at least one cutting structure mounted in a cone area of a first blade on a pad side of the directional drilling apparatus, at least one other cutting structure mounted in a shoulder area of a second blade on a scribe side of the directional drilling apparatus, or any combination thereof.

2. The directional drilling apparatus of claim 1 wherein the drill bit is configured to facilitate increased lateral movement responsive to a cyclical input force from the dynamic lateral pad.

3. The directional drilling apparatus of claim 1 wherein each cutting structure mounted in the cone area of the first blade is skewed inward towards a center of the drill bit by at least three degrees and no more than fifty degrees.

4. The directional drilling apparatus of claim 1 wherein each cutting structure mounted in the shoulder area of the second blade is skewed outward towards a periphery of the drill bit by at least ten degrees and no more than fifty-five degrees.

5. The directional drilling apparatus of claim 1 wherein the drill bit is force balanced for an on-center condition and an off-center condition corresponding to lateral translation of the drill bit due to activation of the dynamic lateral pad.

6. The directional drilling apparatus of claim 5 wherein force balancing adjustments are made iteratively until acceptable force balance values are produced for the on-center condition and the off-center condition.

7. A drill bit mounted in a fixed circumferential relationship with a dynamic lateral pad affixed along a pad side of a directional drilling assembly, wherein the drill bit comprises:

a first blade arranged along the pad side of the directional drilling assembly, wherein the first blade includes one or more cutting structures mounted in a cone area, and wherein each cutting structure mounted in the cone area of the first blade is skewed inward towards a center of the drill bit by at least three degrees and no more than fifty degrees; and a second blade arranged along a scribe side of the directional drilling assembly, wherein the second blade includes a shoulder area that is devoid of cutting structures.

8. The drill bit of claim 7, further comprising:

a second blade arranged along a scribe side of the directional drilling assembly, wherein the second blade includes one or more cutting structures mounted in a shoulder area, wherein each cutting structure mounted in the shoulder area of the second blade is skewed outward towards a periphery of the drill bit by at least ten degrees and no more than fifty-five degrees.

9. The drill bit of claim 8, further comprising:

a third blade arranged along the scribe side of the directional drilling assembly, wherein the third blade includes one or more cutting structures mounted in a shoulder area, wherein each cutting structure mounted in the shoulder area of the third blade is skewed outward towards the periphery of the drill bit by at least ten degrees and no more than fifty-five degrees.

10. A drill bit mounted in a fixed circumferential relationship with a dynamic lateral pad affixed along a pad side of a directional drilling assembly, wherein the drill bit comprises:

a first blade arranged along a scribe side of the directional drilling assembly, wherein the first blade includes one or more cutting structures mounted in a shoulder area, wherein each cutting structure mounted in the shoulder area of the first blade is skewed outward towards a periphery of the drill bit by at least ten degrees and no more than fifty-five degrees, wherein the first blade includes a gauge pad, and wherein the gauge pad includes a lower tungsten carbine content hardfacing than other gauge pads mounted to other blades of the drill bit to facilitate more rapid wear, thereby allowing increased lateral translation of the drill bit responsive to a cyclical input force from the dynamic lateral pad.

11. The drill bit of claim 10 wherein the gauge pad is a circumferentially extended gauge pad designed to limit excessive lateral translation of the drill bit responsive to a cyclical input force from the dynamic lateral pad.

12. The drill bit of claim 10 wherein:

the first blade further includes a lateral translation limiter affixed to the gauge pad, and the lateral translation limiter limits an extent of lateral translation of the drill bit responsive to a cyclical input force from the dynamic lateral pad.

13. The drill bit of claim 12 wherein the lateral translation limiter is comprised of tungsten carbide or polycrystalline diamond compact (PDC).

14. A drill bit mounted in a fixed circumferential relationship with a dynamic lateral pad affixed along a pad side of a directional drilling assembly, wherein the drill bit comprises:

a first blade arranged along a scribe side of the directional drilling assembly, wherein the first blade includes one or more cutting structures mounted in a shoulder area, and wherein each cutting structure mounted in the shoulder area of the first blade is skewed outward towards a periphery of the drill bit by at least ten degrees and no more than fifty-five degrees; and a second blade arranged along the pad side of the directional drilling assembly, wherein the second blade includes a cone area that is devoid of cutting structures.

15. The drill bit of claim 14, further comprising:

a third blade arranged along the scribe side of the directional drilling assembly, wherein the third blade includes one or more cutting structures mounted in a shoulder area, and wherein each cutting structure mounted in the shoulder area of the third blade is skewed outward towards the periphery of the drill bit by at least ten degrees and no more than fifty-five degrees.

16. A drill bit mounted in a fixed circumferential relationship with a dynamic lateral pad affixed along a pad side of a directional drilling assembly, wherein the drill bit comprises:

a first blade arranged along the pad side of the directional drilling assembly, wherein the first blade includes:

a cone area that is devoid of cutting structures, and a shoulder area that has at least one cutting structure; and a second blade arranged along a scribe side of the directional drilling assembly, wherein the second blade includes:

a cone area that has at least one cutting structure, and a shoulder area that is devoid of cutting structures.

17. The drill bit of claim 16, further comprising:

a third blade arranged along the scribe side of the directional drilling assembly, wherein the third blade includes:

a cone area that has at least one cutting structure, and a shoulder area that is devoid of cutting structures.

* * * * *